US005185728A

United States Patent [19]

Gilchrist

[11] Patent Number: 5,185,728

[45] Date of Patent: Feb. 9, 1993

[54] OMNIDIRECTIONAL ULTRASONIC TRANSDUCER

[75] Inventor: Ian R. Gilchrist, Timonium, Md.

[73] Assignee: Cyber Scientific, Baltimore, Md.

[21] Appl. No.: 908,757

[22] Filed: Jul. 6, 1992

Related U.S. Application Data

[63] Continuation of Ser. No. 606,558, Oct. 31, 1990, abandoned.

[51] Int. Cl.[5] ..... H04R 17/00; G10K 11/18

[52] U.S. Cl. ..... 367/163; 367/174; 181/175

[58] Field of Search ..... 367/157, 163, 170, 174; 310/322, 324, 326; 381/168, 169, 173, 188, 190, 191, 205; 181/175, 184, 173, 174

[56] References Cited

U.S. PATENT DOCUMENTS

| | | | |
|---|---|---|---|
| 3,206,558 | 9/1965 | Shoot | 310/324 |
| 3,675,053 | 7/1972 | Mifune et al. | 310/8.2 |
| 3,722,840 | 3/1973 | Yamada | 310/334 |
| 3,749,854 | 7/1973 | Mifune et al. | 179/110 |
| 4,228,379 | 10/1980 | Guscott et al. | 310/322 |
| 4,278,851 | 7/1981 | Takaya | 179/179 |
| 4,283,649 | 8/1981 | Heinouchi | 310/324 |
| 4,456,848 | 6/1984 | Yasuda et al. | 310/322 |
| 4,456,849 | 6/1984 | Takayama et al. | 310/322 |
| 4,486,868 | 12/1984 | Kodera et al. | 367/140 |
| 4,600,851 | 7/1986 | Isayama et al. | 310/324 |
| 4,602,245 | 7/1986 | Yang et al. | 340/384 |
| 4,607,186 | 8/1986 | Takayama et al. | 310/322 |
| 4,891,843 | 1/1990 | Paulus, Jr. et al. | 381/191 |

*Primary Examiner*—Ian J. Lobo
*Attorney, Agent, or Firm*—Perman & Green

[57] ABSTRACT

An ultrasonic transducer is described that comprises an oscillatory element (e.g., piezoelectric or electrostatic) having a frequency of oscillation in the ultrasonic region. The transducer includes a conical diaphragm connected at its apex to the center of the oscillatory element. The diaphragm has a rim which defines a concave opening and is responsive to an actuation of the oscillatory element to generate a plane wave in the direction of the concave opening. A faceplate having a small aperture abuts the rim of the conical diaphragm. The diaphragm is concentrically positioned with respect to the aperture and is bonded to the faceplate by a flexible adhesive. An induced plane wave is thereby diffracted by the aperturre and exits therefrom with a substantially omnidirectional beam pattern.

3 Claims, 2 Drawing Sheets

OMNIDIRECTIONAL ULTRASONIC TRANSDUCER

This is a continuation of copending application Ser. No. 07/606,558 filed on Oct. 31, 1990 now abandoned.

FIELD OF THE INVENTION

This invention relates to ultrasonic transducers, and more particularly, to ultrasonic transducers which exhibit an omnidirectional transmission characteristic.

BACKGROUND OF THE INVENTION

U.S. Pat. application Ser. No. 07/412,885 to the inventor hereof, entitled "Acoustic Digitizing System", an acoustic position locating system is disclosed which employs an acoustic point source transmitter, the structure of which is shown in FIGS. 1 and 2 hereof. The acoustic transmitter comprises a conical resonator 10 mounted on a piezoelectric actuator 12. Both resonator 10 and actuator 12 are mounted on a pedestal 14 and actuator 12 is connected via pins 16 and 18 to a pulse source 20. The transmitter structure is mounted within a housing 22 that has a face plate 24 (see FIG. 2). An opening 26 is centrally located in face plate 24 and provides a "point source" effect for acoustic emanations produced by piezoelectric actuator 12 and resonator 10. The choice of the diameter of opening 26 involves a tradeoff between emitted power and wavefront beamwidth.

As can be seen in FIG. 3, when piezoelectric actuator 12 is energized, it creates a planar acoustic wavefront 30 which impinges upon the inner surface of face plate 24. As wavefront 30 passes through opening 26, assuming opening 26 is sufficiently small, the transmitted waveform assumes an omnidirectional beam pattern 32 due to diffraction effects created by the beveled edges of opening 26.

In the environment of an acoustic position locating system, it is important that wavefront 32 be substantially omnidirectional and uniform to enable accurate position sensing. The structure shown in FIGS. 1 and 2, while accomplishing the aforementioned signal emanation characteristics, requires that the distance between conical resonator 10 and the inner surface of faceplate 24 be very accurately maintained, to maintain a uniform output amplitude wavefront characteristic. This dimension becomes even more critical when more than one transmitter is employed (e.g. on a stylus, where the placement of two transmitters allows both the position and orientation of the stylus to be determined).

Another problem with the acoustic transmitter of FIG. 1 is that piezoelectric element 12 is mounted on a pedestal 14. As a result, when actuator 12 is energized, a portion of its energy is induced into pedestal 14 and thereby is lost.

Other prior art known to the inventor hereof can be found in U.S. Pat. Nos. 4,228,379 to Guscott et al. and 4,278,851 to Takay, both of which show piezoelectric transducers for the generation of sonic signal having substantially omnidirectional wavefronts. U.S. Pat. Nos. 3,675,053 and 3,749,854, both to Mifune et al; 4,283,649 to Heinouchi, 4,456,848 to Yasuda et al.; 4,486,868 to Kodera et al.; and 4,602,245 to Yang et al. all show the use of various cone-shaped acoustic resonators in combination with piezoelectric transducers.

In U.S. Pat. Nos. 4,456,849 and 4,607,186 to Takayama et al., ultrasonic transducers are disclosed which both employ conical resonators and attached piezoelectric actuators. In these patents, however, the resonators support the piezoelectric actuator. Various faceplates are disclosed in the '186 patent for providing directional wavefronts from a horn structure. In addition, the resonators are mounted by ring shaped members of elastic or vibration absorbing substances which hold them in place against a faceplate. The ring-shaped members, used to hold the resonators substantially dampen these vibrations when energized. Such heavy dampening affects not only the output amplitude of the ultrasonic signal, but also the number of cycles thereof which are generated. While the latter is desirable, the former is not and results in a substantial decrease in the output power of the resonator.

Accordingly, it is an object of this invention to provide an improved ultrasonic transmitter.

It is another object of this invention to provide an improved ultrasonic transmitter which exhibits improved output amplitude generation characteristics.

SUMMARY OF THE INVENTION

An ultrasonic transducer is described that comprises a piezoelectric or electrostatic oscillatory element having a frequency of oscillation in the ultrasonic region. The transducer includes a conical diaphragm connected at its apex to the center of the oscillatory element. The diaphragm has a rim which defines a concave opening and is responsive to an actuation of the oscillatory element to generate a plane wave in the direction of the concave opening. A faceplate having a small aperture abuts the rim of the conical diaphragm. The diaphragm is concentrically positioned with respect to the aperture and is bonded to the faceplate by a flexible adhesive. An induced plane wave is thereby diffracted by the aperture and exits therefrom with a substantially omnidirectional beam pattern.

DETAILED DESCRIPTION OF THE INVENTION

Figure 1:
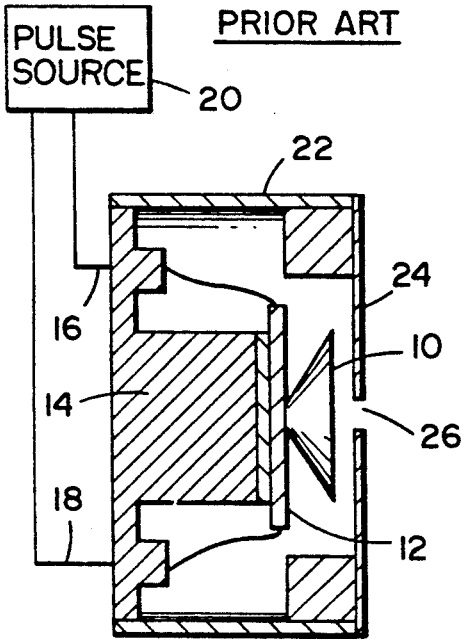
FIG. 1 PRIOR ART
FIG. 1 is a sectional side view of a prior art ultrasonic transducer.
Figure 2:
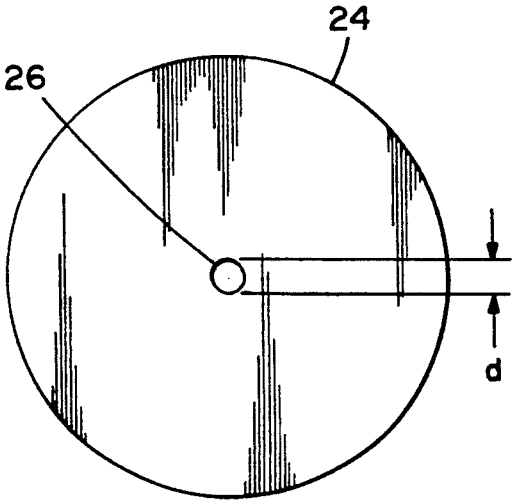
FIG. 2 PRIOR ART
FIG. 2 is a plan view of a faceplate employed with the transducer of FIG. 1.
Figure 3:
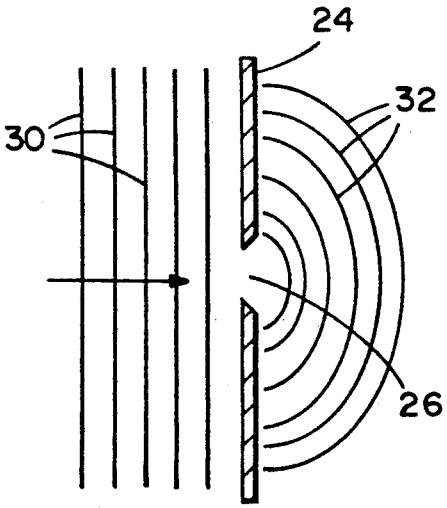
FIG. 3 is a diagram which illustrates the diffraction effects that occur at the beveled opening of the faceplate of FIG. 2.
Figure 4:
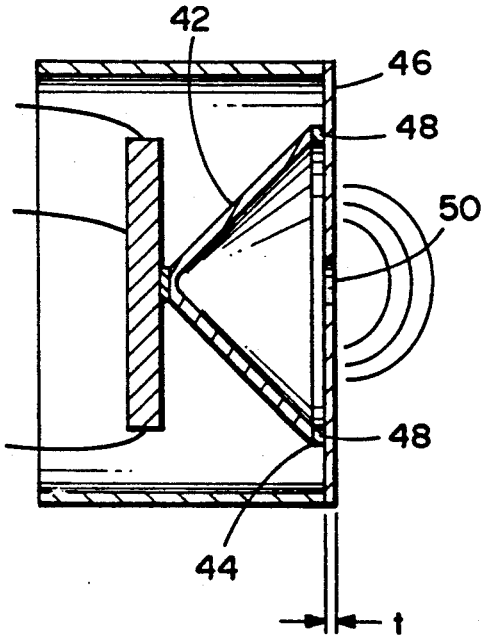
FIG. 4 is a sectional side view of an ultrasonic piezoelectric transducer embodying the invention hereof.
Figure 5:
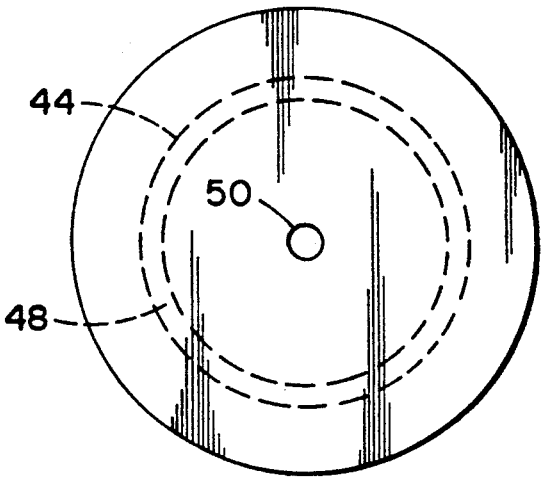
FIG. 5 is a plan view of a faceplate employed with the transducer of FIG. 4.

Referring now to FIGS. 4 and 5, an acoustic point source transmitter incorporating the invention hereof is illustrated. A piezoelectric actuator 40 is attached, via an epoxy cement, to the apex of a conical resonator 42. Rim 44 defines the opening of conical resonator 42. Rim 44 is attached to faceplate 46 by a layer 48 of flexible adhesive. Adhesive 48 is preferably a silicon-rubber adhesive, which, when it is adhered, exhibits a flexibility characteristic that allows movement between resonator 42 and faceplate 46. It is to be noted that adhesive ring 48 is adherent to rim 44 and not to the sides of resonator 42.

Faceplate 46 has a thickness t which is sufficiently small to enable aperture 50 to exhibit the diffraction effects which are seen from a thicker faceplate having a beveled opening. Faceplate 46 must also exhibit sufficient rigidity to not resonate in response to the acoustic signals generated by resonator 42. For instance, faceplate 46 may be comprised of aluminum or brass and be ten mils in thickness. When a conical resonator having a ⅜ inch rim diameter is used, opening 50 should preferably have an approximate opening diameter of 1/16 inch to simulate a point source and enable generation of a wide beamwidth pattern.

Such a structure provides a number of benefits not hereto seen in the prior art. The mounting technique is simple and inexpensive; provides uniform amplitude wavefronts; provides maximum output powers since the damping of the conical resonator is minimized by the resilient rim attachment; but does provide some dampening of the signal after an acceptable number of oscillations. Further, the attachment of piezoelectric element 40 to conical resonator 42 by an epoxy cement provides a simple and strong mounting.

Figure 6:
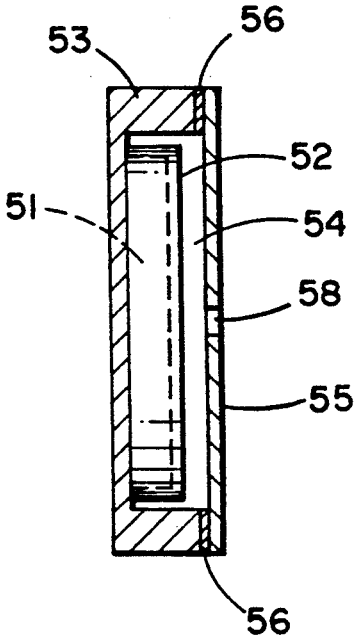
FIG. 6 is a partial sectional side view of an ultrasonic transducer employing an electrostatic energizer.

In FIG. 6, a side view is shown of an acoustic electrostatic point source transducer. A metallic plate 51 is grooved on its planar surface (not shown) and covered by a foil 52 which forms the moving element of the transducer. Foil 52 has an insulated surface in contact with plate 51 and forms a capacitor, which when charged, exerts a force on the foil. Plate 51 and foil 52 are mounted in a container 53 whose open end 54 is closed off by a face plate 55 having a point source aperture 58 therein. Face plate 55 is adhered to the rim of container 53 by a flexible adhesive layer 56. Adhesive 56 is identical in character to adhesive 48 in FIG. 4, as in face plate 55. With the electrostatic transducer, it is also possible to attach the rim of container 53 to face plate 55 with a ring of epoxy cement.

Figure 7:
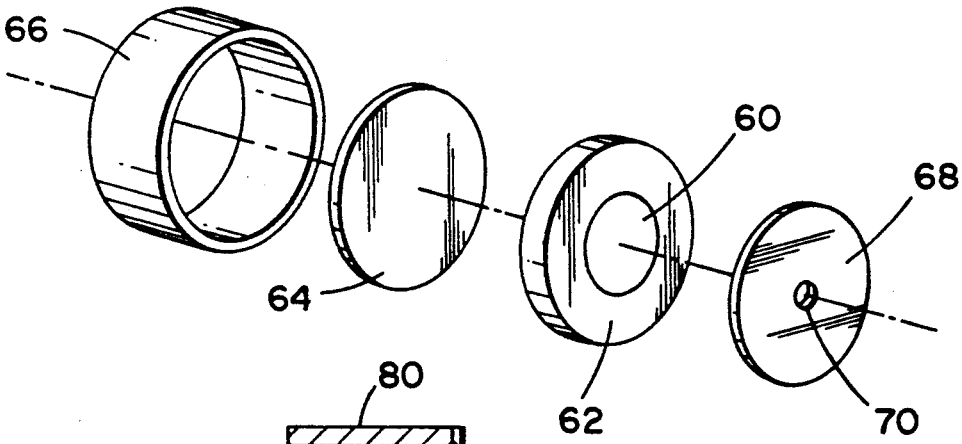
FIG. 7 is an exploded view of an acoustic prior art receiver.

Referring now to FIG. 7 an exploded view of a prior art acoustic receiver is shown. The receiver comprises an electret membrane 60 mounted on an electrode ring 62. A rear electrode plate 64 is mounted behind the front electrode ring 62 and the entire structure is contained within a housing 66. A faceplate 68, having an opening 70, is positioned over membrane 60 and is adhered to the sidewalls of housing 66. Opening 70 provides a "point source" reception capability for the receiver. It has been found that commercially available receivers, such as those shown in FIG. 7, are provided with a very thin faceplate 68. As a result, in addition to acoustic signals being received through aperture 70, they also cause a flexure in faceplate 68 and result in noise being induced into membrane 60.

Figure 8:
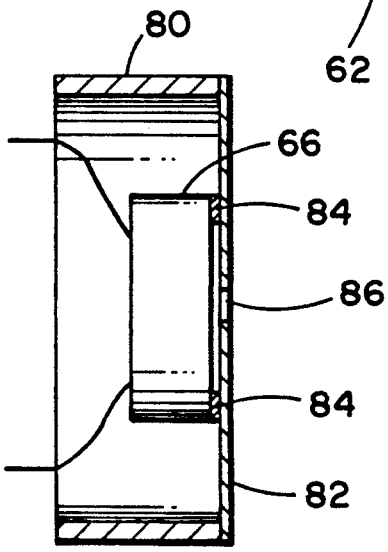
FIG. 8 is a side, partial sectional view showing an improved receiver housing which acoustically damps the microphone's front plate and provides improved signal response characteristics.

In FIG. 8, the microphone structure shown in FIG. 7 has been improved by mounting it in a housing 80 and adhering enclosure 66 to the inner surface of a faceplate 82 with a ring of epoxy cement 84. Faceplate 82 is rigid and does not resonate in response to received acoustic signals. It contains a point source opening 86 which is aligned with opening 70 in the microphone structure. Epoxy ring 84 and rigid front plate 82 both improve the frequency response of the receiver and reduce the noise induced into the microphone by acoustically damping the front plate 68. In addition, the placement of the microphone directly against front plate 82 optimizes its sensitivity and provides consistent input amplitudes and beamwidths from receiver to receiver.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An ultrasonic transducer comprising:

an oscillatory element having a center, for generating vibrations at an ultrasonic frequency;

a conical diaphragm having an apex connected to the center of said oscillatory element, said conical diaphragm having a rim which defines a concave opening, said diaphragm responsive to an actuation of said oscillatory element to generate plane waves in the direction of said concave opening; and a faceplate with a single circular aperture that has a diameter that enables said aperture to exhibit point source characteristics at said ultrasonic frequency, said rim of said conical diaphragm abutting said faceplate, concentrically with said aperture, and bonded to said faceplate by a flexible adhesive that is substantially positionally restricted to an area of contact between said rim and said faceplate, said faceplate having a thickness dimension that, in combination with said aperture diameter enables said plane waves to be diffracted and to exit from said aperture with a substantially omnidirecitonal beam pattern.

2. The ultrasonic transducer of claim 1, wherein said apex of said conical diaphragm is attached to the center of said oscillatory element by a nonflexing adhesive.

3. The unltrasonic transducer of claim 1, wherein said flexible adhesive is a silicon-rubber adhesive coextensive with said rim of said conical diaphragm.

* * * * *